US012492534B2

(12) United States Patent
Menard et al.

(10) Patent No.: US 12,492,534 B2
(45) Date of Patent: Dec. 9, 2025

(54) ACCESSING WELLS BELOW AN OBSTRUCTION OR DISCONTINUITY

(71) Applicant: THRU TUBING SOLUTIONS, INC., Newcastle, OK (US)

(72) Inventors: Toby Menard, New Orleans, LA (US); Andrew M. Ferguson, Moore, OK (US); Roger L. Schultz, Ninnekah, OK (US); Steven A. Ariss, Boyers, PA (US); Dustin Locklear, Moore, OK (US); Nigel Rowcliffe, Mount Pleasant, MI (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/822,383

(22) Filed: Sep. 2, 2024

(65) Prior Publication Data

US 2025/0101809 A1 Mar. 27, 2025

Related U.S. Application Data

(60) Provisional application No. 63/646,046, filed on May 13, 2024, provisional application No. 63/632,933,
(Continued)

(51) Int. Cl.
*E03B 3/15* (2006.01)
*E21B 4/02* (2006.01)
(Continued)

(52) U.S. Cl.
CPC ..... *E03B 3/15* (2013.01); *E21B 4/02* (2013.01); *E21B 7/04* (2013.01); *E21B 29/06* (2013.01);
(Continued)

(58) Field of Classification Search
CPC ..... E03B 3/15; E21B 4/02; E21B 7/04; E21B 29/06; E21B 33/13; E21B 47/024; E21B 47/12
See application file for complete search history.

(56) References Cited

U.S. PATENT DOCUMENTS 3,242,985 A * 3/1966 North ..... E21B 31/00 175/45
3,406,766 A 10/1968 Keller
(Continued)

OTHER PUBLICATIONS

Halliburton, "Relief Well Planning & Magnetic Ranging," services brochure, 55 pages, dated Oct. 2020.
(Continued)

*Primary Examiner* — Aaron L Lembo
(74) *Attorney, Agent, or Firm* — Smith IP Services, P.C.

(57) ABSTRACT

A system can include a tubular string with a drilling bottom hole assembly connected at a distal end of a coiled tubing including a communication line permitting communication between surface instrumentation and the drilling bottom hole assembly, and the drilling bottom hole assembly including an orienter and ranging equipment. The tubular string is positioned in an intercept wellbore which intersects a target wellbore downhole of an obstruction that prevents access to the target wellbore downhole of the obstruction. A method can include drilling an intercept wellbore outward from an original wellbore, after an obstruction is introduced between the original wellbore and a target wellbore, and intersecting the target wellbore with the intercept wellbore, so that fluid communication is provided between the intercept and target wellbores.

26 Claims, 14 Drawing Sheets

Related U.S. Application Data filed on Apr. 11, 2024, provisional application No. 63/632,140, filed on Apr. 10, 2024, provisional application No. 63/585,483, filed on Sep. 26, 2023.

(51) Int. Cl.

| | |
|---|---|
| ***E21B 7/04*** | (2006.01) |
| ***E21B 29/06*** | (2006.01) |
| ***E21B 33/13*** | (2006.01) |
| ***E21B 47/024*** | (2006.01) |
| ***E21B 47/12*** | (2012.01) |

(52) U.S. Cl.

CPC ..... *E21B 33/13* (2013.01); *E21B 47/024* (2013.01); *E21B 47/12* (2013.01)

(56) References Cited

U.S. PATENT DOCUMENTS

| | | | | |
|---|---|---|---|---|
| 5,059,064 | A | 10/1991 | Justice | |
| 5,074,365 | A | 12/1991 | Kuckes | |
| 5,230,387 | A | 7/1993 | Waters et al. | |
| 5,289,888 | A | 3/1994 | Talley | |
| 5,343,965 | A | 9/1994 | Talley | |
| 5,396,950 | A | 3/1995 | Talley | |
| 5,771,976 | A | 6/1998 | Talley | |
| 6,135,206 | A * | 10/2000 | Gano | E21B 7/061 166/65.1 |
| 6,695,056 | B2 * | 2/2004 | Haugen | E21B 7/061 166/55.2 |
| 6,856,255 | B2 * | 2/2005 | Chalitsios | G08C 19/16 340/854.6 |
| 7,036,584 | B2 | 5/2006 | Zupanick et al. | |
| 7,360,595 | B2 | 4/2008 | Zupanick et al. | |
| 7,493,951 | B1 | 2/2009 | Kravits et al. | |
| 7,513,304 | B2 | 4/2009 | Stayton | |
| 8,297,377 | B2 | 10/2012 | Zupanick et al. | |
| 8,333,245 | B2 | 12/2012 | Zupanick et al. | |
| 8,375,052 | B2 | 2/2013 | Bordeaux et al. | |
| 8,376,039 | B2 | 2/2013 | Zupanick | |
| 8,919,441 | B2 * | 12/2014 | Parlin | E21B 43/30 166/117.6 |
| 9,145,767 | B2 | 9/2015 | Borges et al. | |
| 9,644,463 | B2 | 5/2017 | Dallas | |
| 10,018,004 | B2 * | 7/2018 | Abrant | E21B 29/02 |
| 10,125,561 | B2 * | 11/2018 | Cramm | E21B 7/06 |
| 10,174,558 | B2 * | 1/2019 | Hess | E21B 7/06 |
| 10,294,777 | B2 | 5/2019 | Jarman et al. | |
| 10,392,929 | B1 * | 8/2019 | Servin | G01V 3/12 |
| 10,487,644 | B2 | 11/2019 | Hess et al. | |
| 11,365,585 | B1 | 6/2022 | Watson et al. | |
| 11,852,384 | B2 | 12/2023 | Toews et al. | |
| 2002/0096336 | A1 | 7/2002 | Zupanick et al. | |
| 2002/0189801 | A1 | 12/2002 | Zupanick et al. | |
| 2004/0050554 | A1 | 3/2004 | Zupanick et al. | |
| 2004/0108110 | A1 | 6/2004 | Zupanick | |
| 2005/0087340 | A1 | 4/2005 | Zupanick et al. | |
| 2006/0266517 | A1 | 11/2006 | Stayton | |
| 2006/0266521 | A1 | 11/2006 | Pratt et al. | |
| 2009/0084534 | A1 | 4/2009 | Zupanick | |
| 2009/0095530 | A1 | 4/2009 | Waters et al. | |
| 2009/0120691 | A1 | 5/2009 | Waters et al. | |
| 2010/0018770 | A1 | 1/2010 | Moriarty et al. | |
| 2012/0205159 | A1 | 8/2012 | Borges et al. | |
| 2013/0153224 | A1 * | 6/2013 | Parlin | E21B 4/18 166/298 |
| 2014/0174740 | A1 * | 6/2014 | Parlin | E21B 7/061 166/298 |
| 2014/0367170 | A1 | 12/2014 | Hoehn et al. | |
| 2015/0027714 | A1 * | 1/2015 | Parlin | E21B 37/00 166/113 |
| 2016/0259079 | A1 * | 9/2016 | Wilson | E21B 47/09 |
| 2017/0248006 | A1 | 8/2017 | Hess et al. | |
| 2019/0071939 | A1 | 3/2019 | Zheng et al. | |
| 2021/0285323 | A1 * | 9/2021 | Davis | E21B 47/12 |
| 2022/0003459 | A1 | 1/2022 | Toews et al. | |
| 2022/0090484 | A1 | 3/2022 | Moss | |
| 2025/0101720 | A1 | 3/2025 | Greenly et al. | |
| 2025/0101809 | A1 | 3/2025 | Menard et al. | |
| 2025/0101810 | A1 | 3/2025 | Rowcliffe et al. | |

OTHER PUBLICATIONS

Iscwsa, "Wellbore Ranging Technologies, Intercept Applications and Best Practices," dated 2016, 103 pages.

James Roberts, "Are Horizontal Wells Right for Development of Groundwater Resources in the Garber-Wellington Aquifer?," dated 2019, 11 pages.

Office Action issued Jul. 21, 2025 for U.S. Appl. No. 18/891,667, 27 pages.

Office Action issued May 1, 2025 for U.S. Appl. No. 18/828,880, 14 pages.

Office Action issued Jul. 30, 2025 for U.S. Appl. No. 18/828,880, 11 pages.

* cited by examiner

ACCESSING WELLS BELOW AN OBSTRUCTION OR DISCONTINUITY

CROSS-REFERENCE TO RELATED APPLICATIONS

This application claims the benefit of the filing dates of U.S. provisional application Nos. 63/585,483 filed 26 Sep. 2023, 63/632,140 filed 10 Apr. 2024, 63/632,933 filed 11 Apr. 2024, and 63/646,046 filed 13 May 2024. The entire disclosures of these prior applications are incorporated herein by this reference for all purposes.

BACKGROUND

This disclosure relates generally to equipment utilized and operations performed in conjunction with a subterranean well and, in an example described below, more particularly provides for accessing wells below an obstruction or discontinuity.

In some situations, access to a wellbore downhole of an obstruction may be prevented. The obstruction could completely or substantially prevent access to the wellbore downhole of the obstruction. For example, the obstruction could result from collapsed, sheared or displaced casing, a substantial restriction or plug in the wellbore, etc.

It will, therefore, be readily appreciated that improvements are needed in the art. The present disclosure provides such improvements, which may be utilized in a wide variety of different well systems and operations.

DETAILED DESCRIPTION

Figure 1:
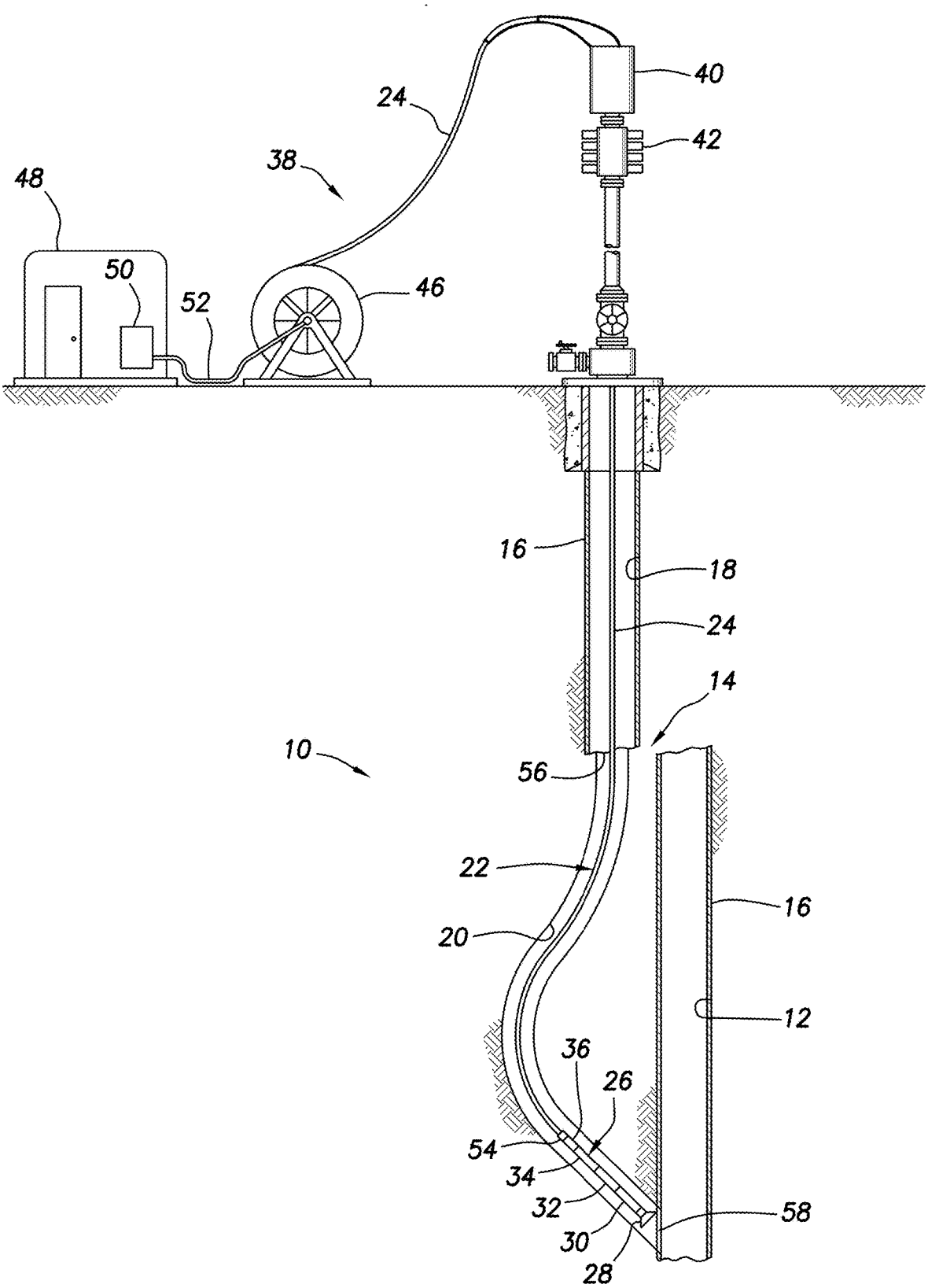
FIG. 1 is a representative partially cross-sectional view of an example of a well system and associated method which can embody principles of this disclosure.

Representatively illustrated in the accompanying drawings is a system 10 for use with a subterranean well, and an associated method, which can embody principles of this disclosure. However, it should be clearly understood that the system 10 and method are merely examples of an application of the principles of this disclosure in practice, and a wide variety of other examples are possible. Therefore, the scope of this disclosure is not limited at all to the details of the system 10 and method described herein and/or depicted in the drawings.

In one aspect of this disclosure, a method of accessing wellbores downhole of subterranean obstructions or other discontinuities (such as, sheared, or otherwise interrupted or obstructed casing/wellbores) are described. The method may be used for plugging wells, for relief wells, repurposing of wells, to place wells back in production, or any other purpose. In the description that follows, examples are disclosed for plugging operations, but it will be appreciated that the examples can be suitably modified for other types of operations (including, but not limited to, relief wells, repurposing of wells, to place wells back in production, etc.).

For each of the above reasons for using coiled tubing ranging while drilling, tubing, liner or casing might be installed after gaining access to the target wellbore. Multiple strings might be required.

For any reason, including plugging, the target wellbore may need to be cleaned out, drilled out and/or a fish retrieved to achieve the objective. There may be cases where the target wellbore cannot be reached, such that another sidetrack and wellbore access process is required to access the isolated wellbore below.

A basic example method for a plugging operation can be broken down as follows:

Use a workstring (coiled tubing or jointed pipe) to drill an access (intercept) wellbore adjacent to and close to or contacting the wellbore to be accessed at a point below an obstruction. This can be done by entering the original wellbore and then exiting the casing above the obstruction either by milling an exit window in the wellbore/casing, or drilling out through the obstruction and then continuing to drill to a location in the target wellbore below the obstruction (e.g., see FIGS. 1 & 2).

This operation can use a steerable drilling assembly and a ranging means by which the drilling bottom hole assembly (BHA) can be steered toward the target wellbore below the obstruction, so that some means for establishing fluid communication between the intercept wellbore and the target wellbore below the obstruction can be utilized. One method for establishing such fluid communication is to use coiled tubing with a steerable motor BHA with ranging means in the BHA which has a communication channel to the surface, so that the drilling/ranging/steering operation can be achieved without the need for removing the BHA from the wellbore.

The scope of this disclosure includes the use of any suitable ranging method/means for guiding the intercept wellbore to the target wellbore below the obstruction. The scope of this disclosure also includes performing this operation so that all or part of the operation is performed using a combination of a jointed pipe rig and a coiled tubing rig. For instance, an exit window in the original wellbore above the obstruction (e.g., window 60 depicted in FIGS. 2, 3A, 4A, 5A, 6A, 7A & 8) may be created using a jointed pipe rig and the rest of the operations described herein may be performed using a coiled tubing rig.

Ranging techniques can be used for: a.) ranging towards a target, b.) identifying adjacent wellbores to avoid ranging towards the wrong wellbore, or c.) collision avoidance with adjacent wellbores.

Fluid communication is created with the interior of the target wellbore below the obstruction, and then the target wellbore, the intercept wellbore and junctions can be sealed with cement or other sealing material. This can be done using any method to create a passageway between the intercept wellbore and the target wellbore below the obstruction. Methods for creating the passageway include (but are not limited to) mechanically milling a hole or window in the target wellbore from outside, or tubing conveyed perforating (TCP), abrasively perforating or mechanically perforating the target wellbore below the obstruction from the outside.

If a window is drilled/milled from the intercept wellbore to the target wellbore below the obstruction, a cement plug may be set in the target wellbore below the obstruction, for example, using coiled tubing, jointed tubing or wireline. In any event, after fluid communication is established, an open hole packer may be used on a tubing string in the intercept wellbore, or in the original wellbore above the obstruction, to seal off an annulus between the wellbore and the tubing, in order to aid in pumping cement through the tubing into the target wellbore below the obstruction, the intercept wellbore, the original wellbore above the obstruction, and/or any wellbore junctions/windows.

Gaining access to the target wellbore can be: a.) full and unobstructed such that the drill string can enter the target wellbore, b.) restricted access such that a slim work string either open ended or with slim tools can enter the target wellbore, or c.) holed or slotted for fluid communication with the target wellbore.

Milling/drilling, perforating or cutting can be used to achieve the above access types. A window can be abrasively cut into the target wellbore casing for either full or restricted access.

Figure 3A:
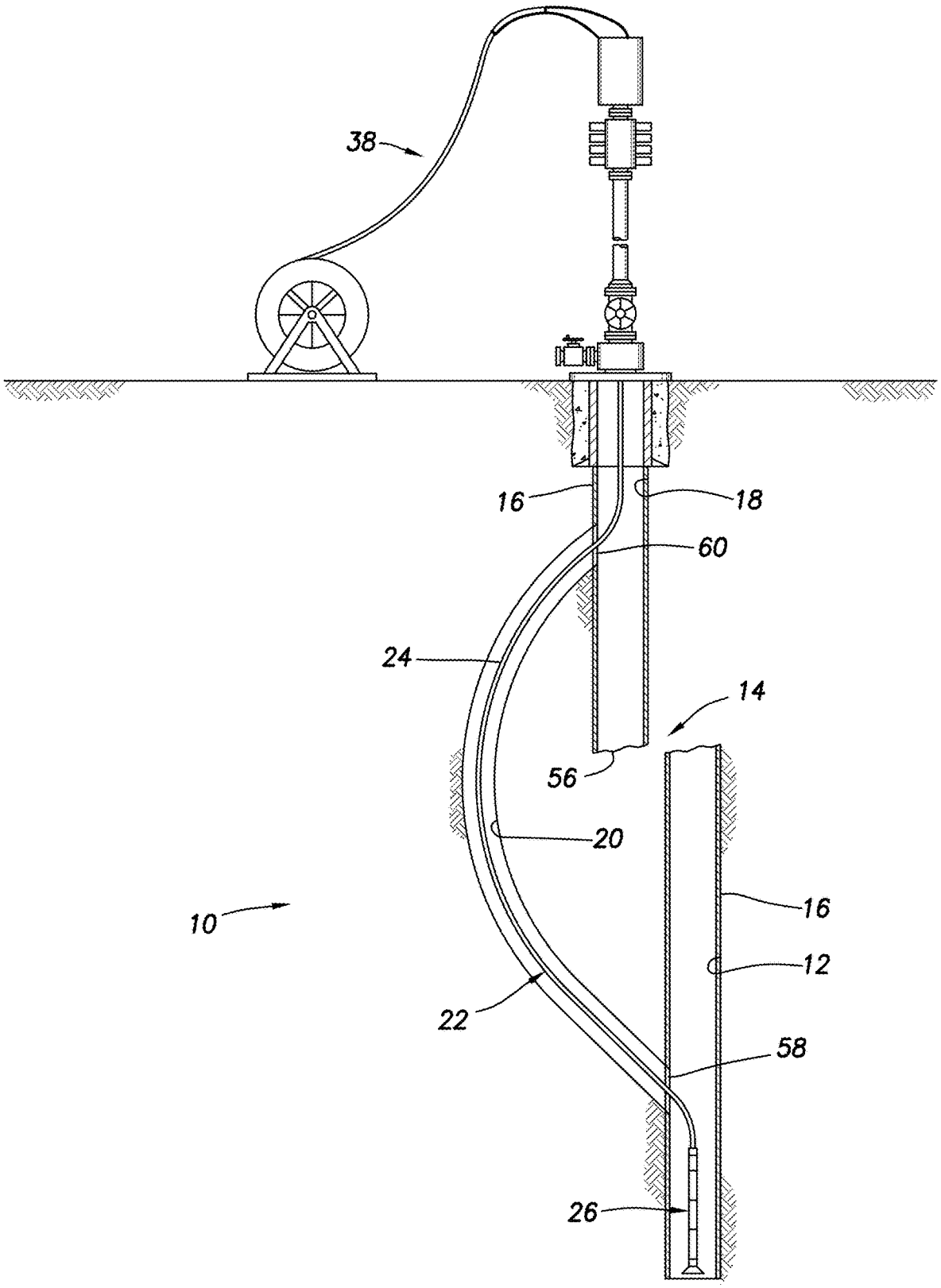

FIGS. 3A & B depict one method in which a drilling BHA is used to mill a window into the target wellbore below the obstruction for full unobstructed access into the target wellbore. A workstring is then advanced through the window and into the target wellbore to a desired depth. Cleaning, washing, drilling, milling, fishing, etc., operations may then be performed in the target wellbore below the obstruction. Cement or other sealing material is then pumped through the BHA into the target wellbore.

In one method, the cement is pumped as the workstring is withdrawn to "spot" the cement evenly along the length of the target wellbore below the obstruction, junctions, intercept wellbore and the original wellbore above the obstruction. A separate workstring and/or BHA can be used to reenter and place the cement into a wellbore to be plugged.

Figure 4A:
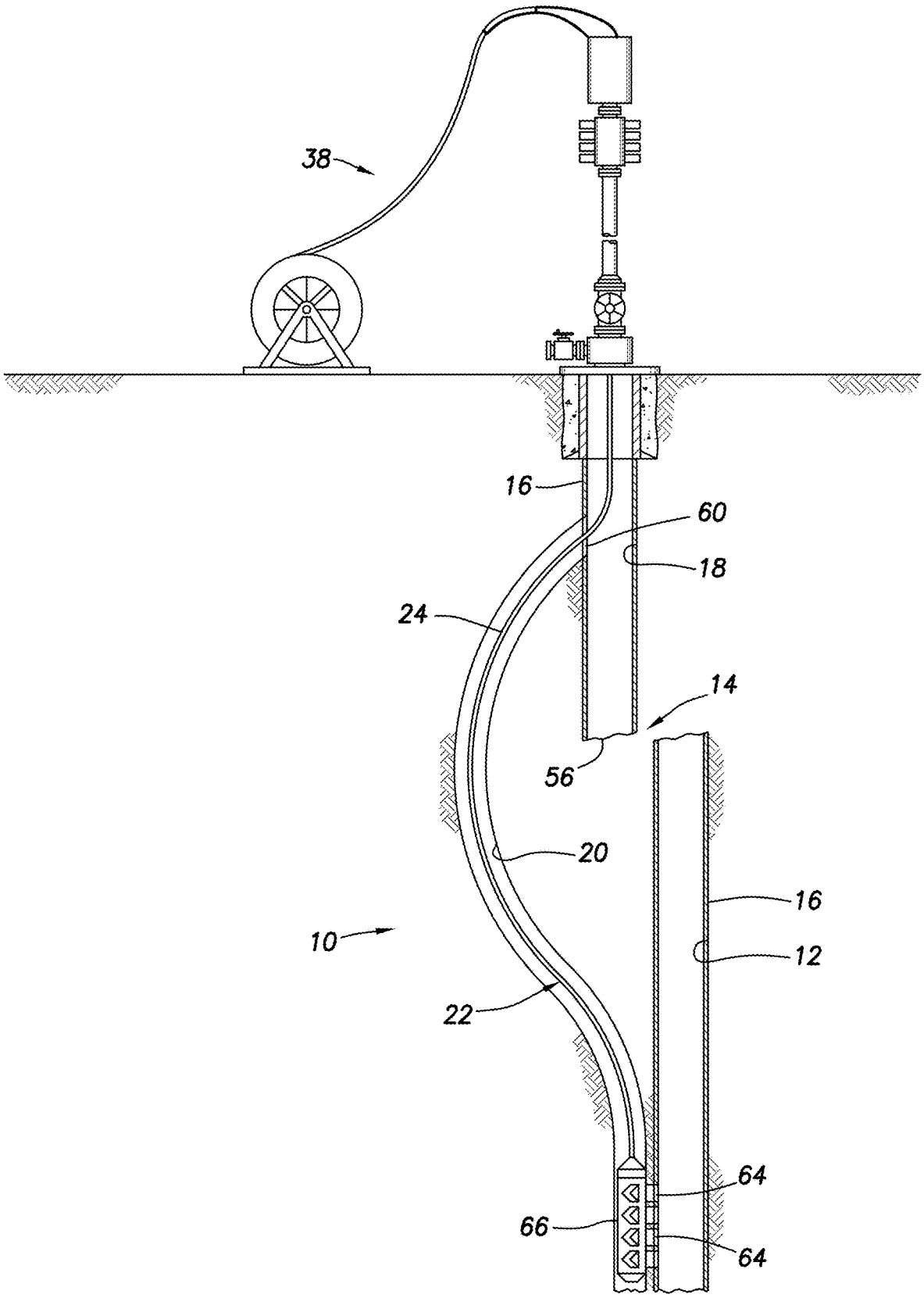

FIGS. 4A & B show another method of accessing and sealing the target wellbore. In this method, an intercept wellbore is drilled either through a window in the original wellbore above the obstruction, or through the obstruction. The intercept wellbore is drilled until it is adjacent to the target wellbore below the obstruction for a suitable overlap distance.

A perforating BHA (conveyed, e.g., on coiled tubing, wireline or jointed tubing) is then used to create fluid communication with the target wellbore below the obstruction. Cement or other sealing material is then pumped through the perforations/cuts and into the target wellbore to seal the target wellbore. Cement can then be pumped or "spotted" into the junction(s) and intercept wellbore as the tubing is withdrawn from the well. A separate workstring and/or BHA can be used to reenter and place the cement into the wellbore to be plugged.

Figure 5A:
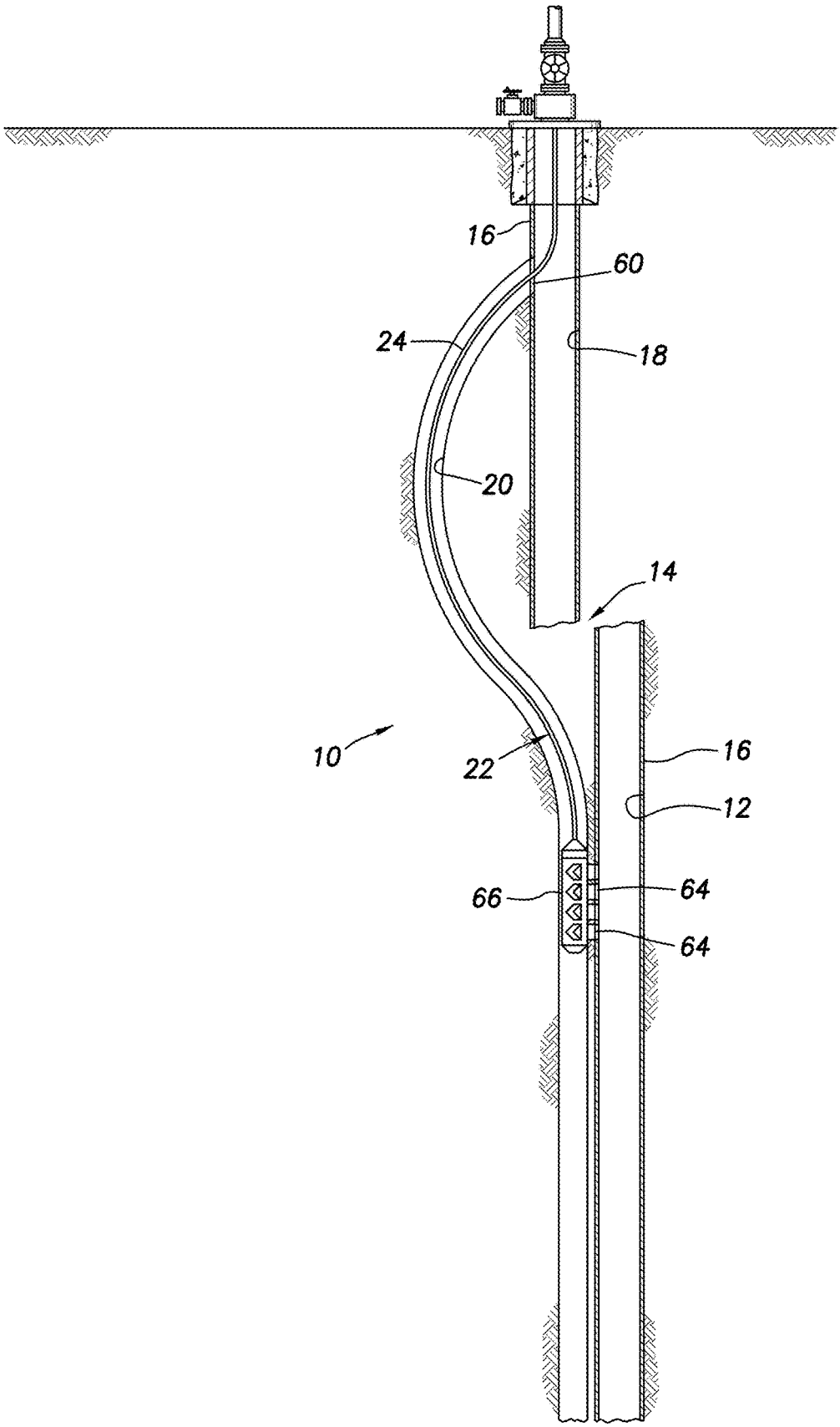
Figure 5B:
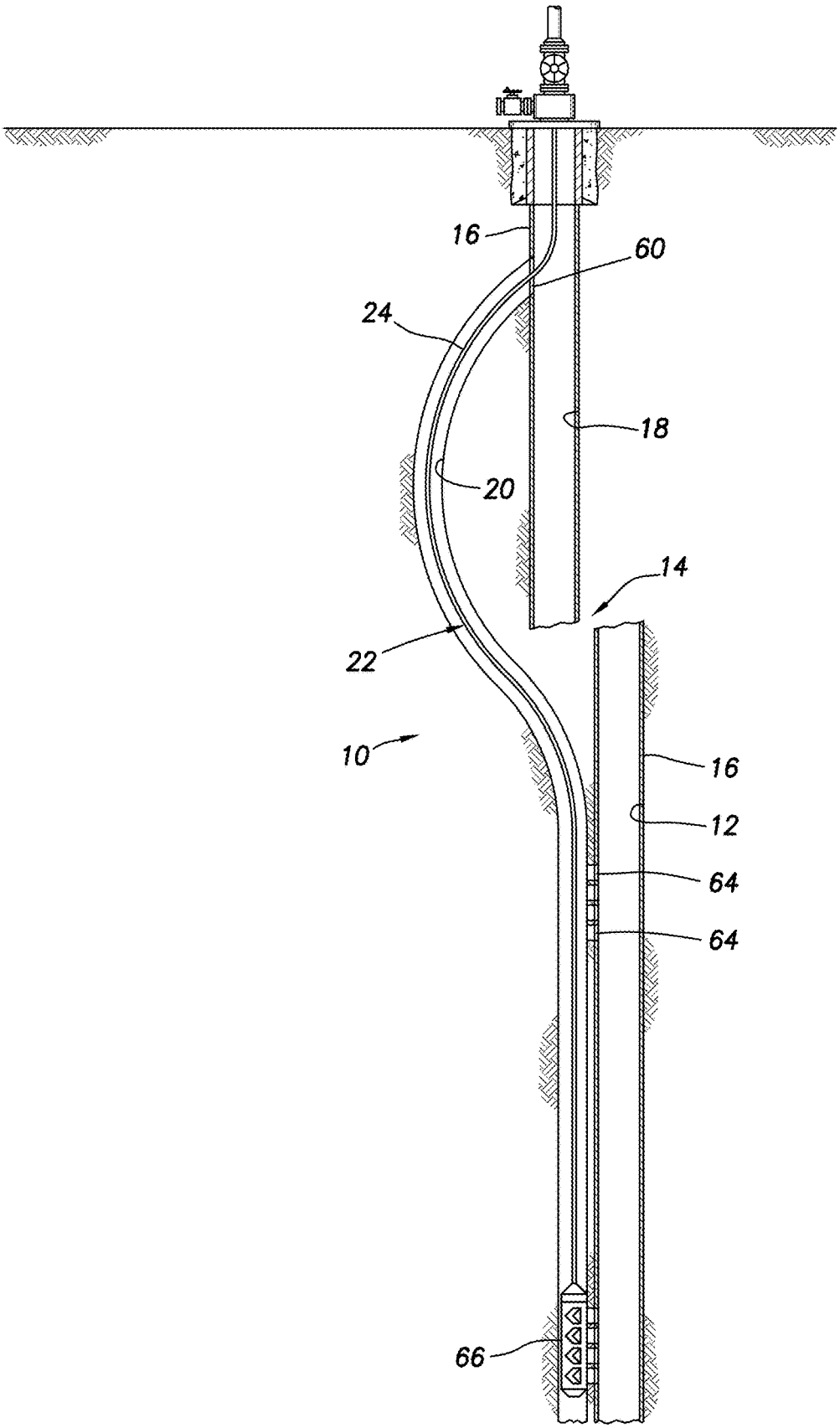
Figure 5C:
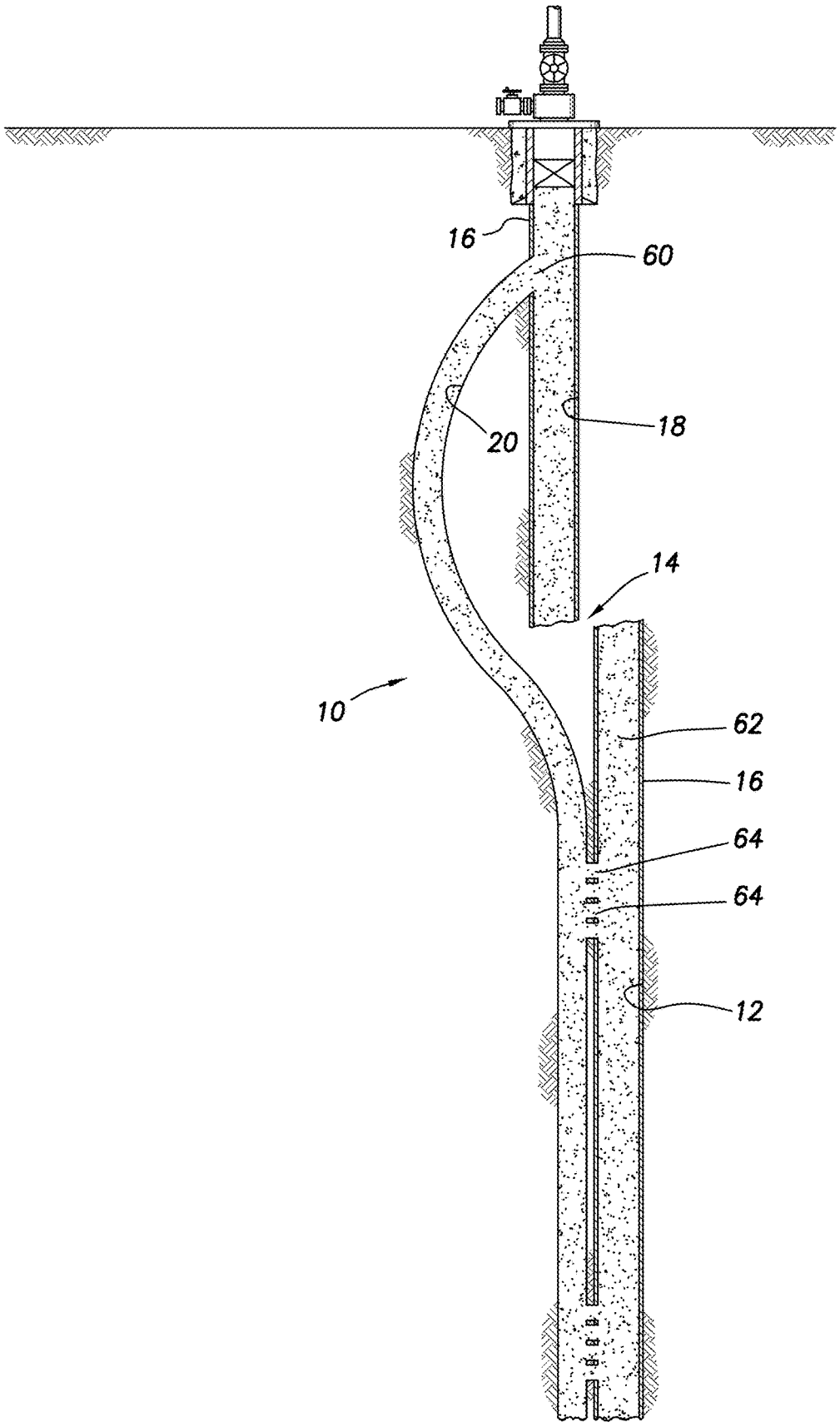

FIGS. 5A-C depict a variation of the method described above, in which at least a portion of the intercept wellbore is drilled below the obstruction near the target wellbore and adjacent to the target wellbore, and is then drilled further until a section of the intercept wellbore is drilled near a deeper or further downhole part of the target wellbore and adjacent to the target wellbore. A perforating BHA is then used to create fluid communication between the intercept wellbore and target wellbore at the places where the two wellbores are adjacent to each other. Cement can then be pumped from a tubing string into one set of perforations through the target wellbore and out of the second set of perforations.

In one scenario, the cementing BHA may be located near the lower set of perforations in the intercept wellbore. Cement is then pumped into both the intercept wellbore and the target wellbore through the lower perforations. The cement which is heavy will displace lighter wellbore fluid in both the intercept wellbore and target wellbore up to the upper set of perforations.

Cement could also be spotted all the way up to the upper set of perforations. The tubing is then withdrawn from the intercept wellbore and cement spotted into the intercept wellbore above the top set of perforations and upper window, etc. A separate workstring and/or BHA can be used to reenter and place the cement into the wellbore to be plugged.

Figure 6A:
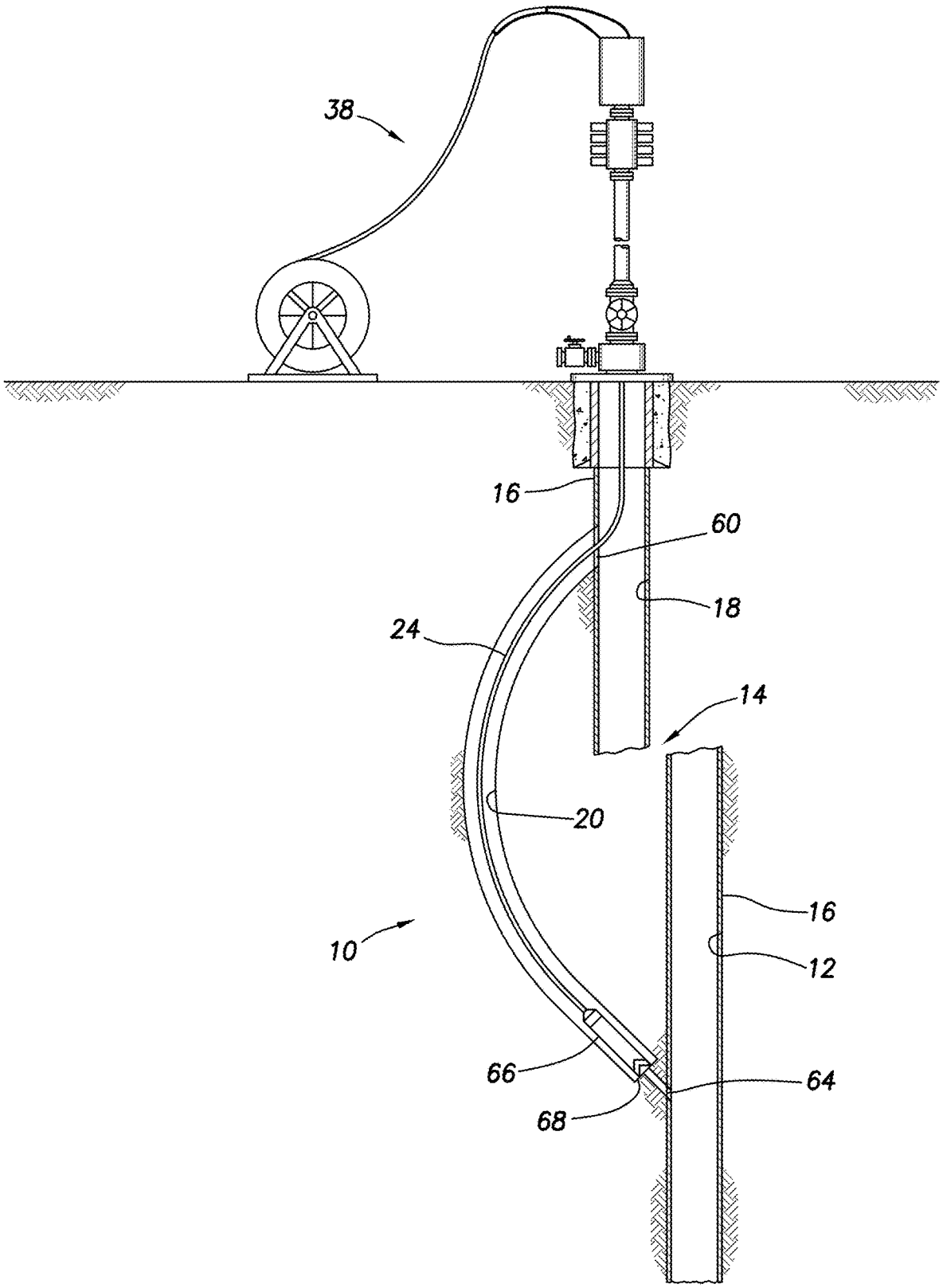

FIGS. 6A & B depict a variation of the above methods in which a perforating BHA having a substantially axial perforating direction with respect to the BHA is used. In this case the intercept wellbore does not have to be adjacent to the target wellbore below the obstruction, in order to be perforated. The intercept wellbore only has to be pointed toward the target wellbore to be perforated. A separate workstring and/or BHA can be used to reenter and place the cement into the wellbore to be plugged.

Figure 7A:
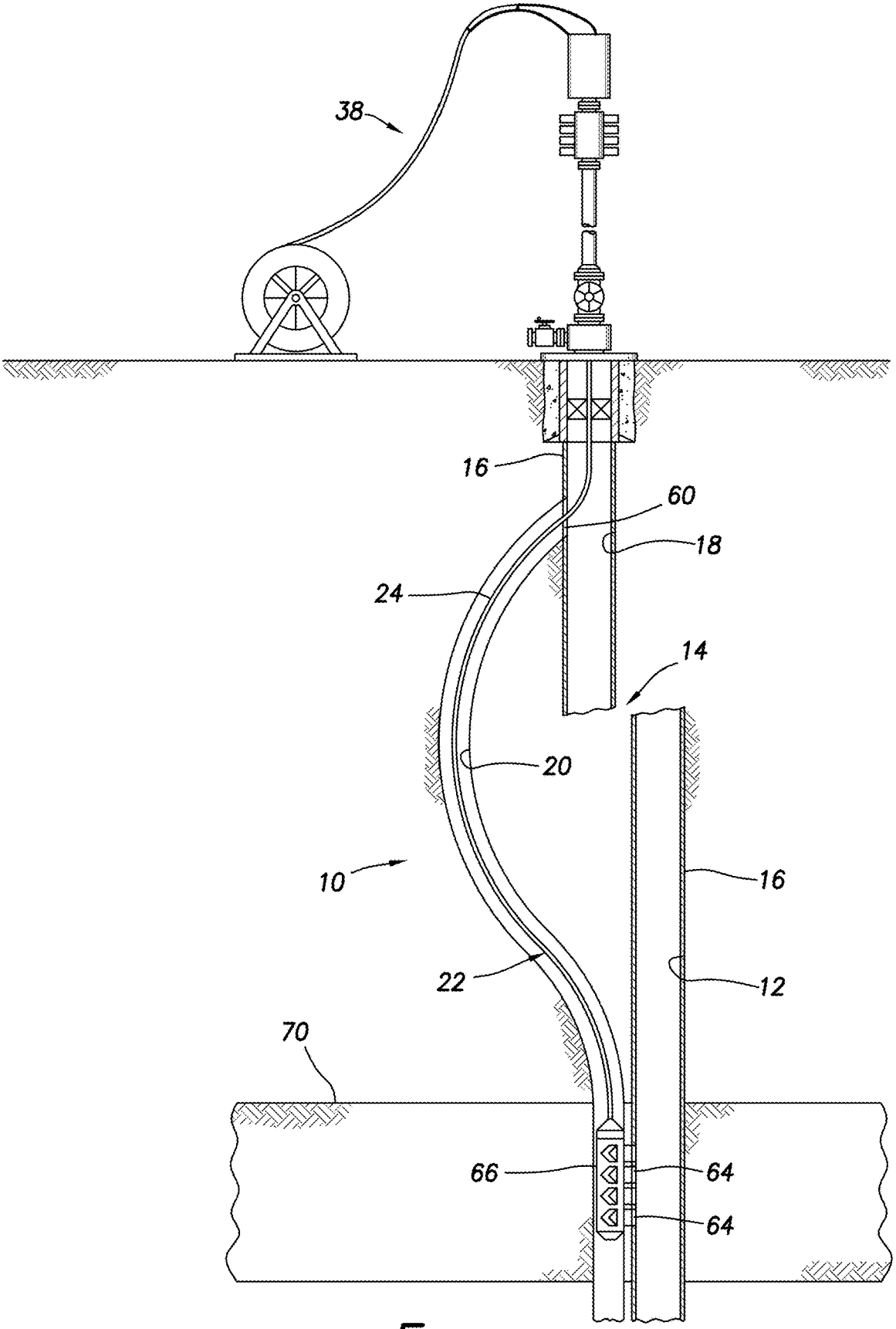

FIGS. 7A & B depict another method in which the intercept wellbore is drilled to a location adjacent to the target wellbore below the obstruction, at a location where the target wellbore penetrates a producing formation. Perforations can be created between the intercept wellbore and the target wellbore to allow cement to be pumped from the intercept wellbore into the target wellbore.

In some cases, it may not be necessary to create perforations to establish fluid communication between the intercept wellbore and the target wellbore, since the producing formation may be sufficiently permeable to permit fluid communication through the formation between the wellbores. A separate workstring and/or BHA can be used to reenter and place the cement into the wellbore to be plugged.

Figure 8:
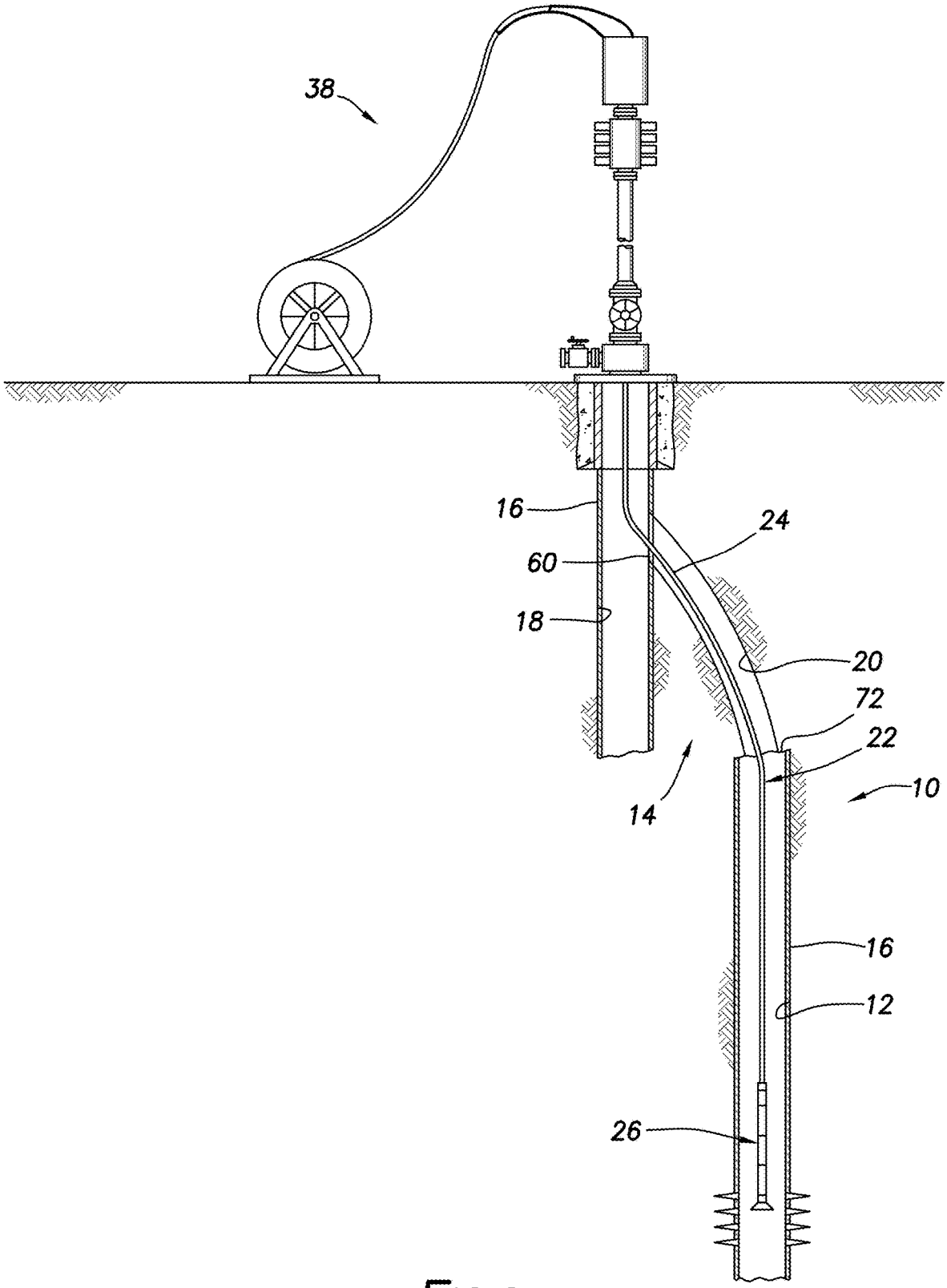

FIG. 8 depicts a possible modification to each of the above methods, in which the target wellbore below the obstruction is accessed through substantially the upper end of the target wellbore at the obstruction.

In one example, a drilling pass-by may be performed to complete a ranging survey to locate the target wellbore casing and the top of the target wellbore. Then a cement kick plug may be set or the entire drilled wellbore may be cemented before drilling to the target wellbore.

Any reference herein to perforating can include any method of creating perforations. The fluid motor (drilling/milling) BHA, perforating BHA and cementing BHA can be combined all, or in part, along with the ranging equipment. The entire operation (exiting the target casing above the obstruction, drilling the intercept wellbore, establishing communication with the target wellbore below the obstruction, and plugging) may be performed in a single trip into the well.

The ranging equipment may be configured for active magnetic ranging, passive magnetic ranging, ground penetrating radar, acoustic ranging, or any other type of ranging. Communication between the ranging equipment and an operator at a surface of the well may be maintained during drilling/milling operations, for example, via wired or wireless transmission/telemetry. Orientation of a drilling/milling BHA tool face may be controlled from the surface, for example, via wired or wireless transmission/telemetry.

Any of the systems and methods described herein may include any of the following features: For casing exits, a) setting a whipstock using coiled tubing, b) orienting to set the whipstock in a particular direction, and c) milling a window with coiled tubing to exit the casing. After casing exit, a) steering the coiled tubing to run parallel with existing casing, b) steering the coiled tubing to go around the obstruction in existing casing, c) ranging off of the coiled tubing to navigate, d) ranging, drilling and intersecting, with a coiled tubing BHA, in one run to plug and abandon wells, and e) using an adjustable housing motor to intersect the target wellbore below the obstruction and mill/drill into the target wellbore from outside the target wellbore.

For forming an intersection or junction between the intercept and target wellbores, a) milling/drilling back into casing from outside the casing, b) abrasive cutting with coiled tubing to penetrate the casing from outside, and c) using perforating guns on coiled tubing to penetrate the casing from outside.

For cementing, a) pumping cement through coiled tubing to plug a wellbore from outside of casing, b) pumping cement through an intercept wellbore to plug another wellbore from outside of casing, c) using an open hole packer carried on tubing/pipe to seal off an annulus in the intercept wellbore to help pump cement into casing from outside the casing, and d) reentering casing from outside with coiled tubing to set a cement plug. Note that plugging may not be performed, or may not be performed for any particular wellbore, in other examples.

Referring specifically now to FIG. 1, the well system 10 is representatively illustrated as a drilling and intersecting operation is being performed. These operations are being performed to provide access to a target wellbore 12 downhole of an obstruction 14. In this example, the obstruction 14 comprises a sheared or separated casing string 16 that lines the target wellbore 12 and an original wellbore 18 uphole of the obstruction. In other examples, other types of obstructions 14 (such as, collapsed casing, a plug, a substantial restriction, etc.) may be introduced between the original wellbore 18 and the target wellbore 12.

As used herein the terms "casing" and "casing string" are used to indicate a wellbore lining. Casing may comprise tubulars of the types known to those skilled in the art as casing, liner, pipe or tubing. A casing "string" can be made up of multiple individual casing "joints," or continuous or formed in situ casing may be used.

Although in the FIG. 1 example, the target wellbore 12 is depicted as being separated somewhat from the original wellbore 18, prior to the shearing or separating of the casing string 16 the target wellbore was a lower or downhole section of the original wellbore 18. Thus, the target wellbore 12 is a section of the original wellbore 18 downhole of the obstruction 14. The target wellbore 12 is a "target" in that it is the wellbore to which efforts to establish access are directed in this example.

To access the target wellbore 12, an intercept wellbore 20 is drilled from the original wellbore 18 to the target wellbore 12. In the FIG. 1 example, a tubular string 22 is used to drill the intercept wellbore 20. The tubular string 22 comprises a substantially continuous tubular 24 (such as, coiled tubing) and a drilling bottom hole assembly (BHA) 26 connected at a distal end of the coiled tubing. In other examples, the tubular 24 can instead, or in addition, comprise multiple jointed tubulars.

In this example, the BHA 26 includes a drill bit 28, a mud motor 30, a steering tool 32, ranging equipment 34, logging tools 36 and an orienter 54. Other tools or equipment, and other combinations of tools, may be used in other examples.

The orienter 54 is used to rotate the drilling BHA 26 downhole of the orienter. For example, the orienter 54 may rotate the drilling BHA 26 in order to change an orientation of the ranging equipment 34 relative to the target wellbore 12 (e.g., to adjust an orientation of a magnetometer of the ranging equipment relative to the casing string 16).

The logging tools 36 can include continuous gamma, resistivity, nuclear magnetic resonance and/or other types of logging tools. The outputs of the logging tools 36 may be used to determine how to steer the intercept wellbore 20, so that it intersects the target wellbore 12. However, the scope of this disclosure is not limited to any particular purpose or combination of purposes for use of the logging tools 36.

The ranging equipment 34 may include equipment for active or passive ranging to the target wellbore 12. For example, the ranging equipment 34 could include a magnetometer, a rotating magnet, a current injection tool, an acoustic ranging tool, ground penetrating radar or another type of ranging equipment. The ranging equipment 34 is used in the FIG. 1 system 10 to determine how to steer the intercept wellbore 20, so that it intersects the target wellbore 12.

Note that the drilling and ranging operations can be performed while the tubular string 22 remains in the intercept wellbore 20. The drilling and ranging operations can be performed in a single trip of the coiled tubing 24 with the BHA 26 into the intercept wellbore 20.

The steering tool 32 is used to steer the drill bit 28 and thereby steer the drilling of the intercept wellbore 20. Various different types of steering tools are commercially available and known to those skilled in the art.

The mud motor 30 is used to rotate the drill bit 28 and thereby drill the intercept wellbore 20. Fluid circulated through the tubular string 22 causes the mud motor 30 to rotate the drill bit 28. The fluid exits nozzles in the drill bit 28 and returns to the surface via an annulus formed between the original and intercept wellbores 18, 20 and the coiled tubing 24.

A coiled tubing rig 38 is used at the surface to deploy and retrieve the tubular string 22. In this example, the coiled tubing rig 38 includes an injector head 40 and a blowout preventer stack 42 connected above a wellhead 44. The coiled tubing 24 is unwound from a reel or spool 46.

A control cab 48 is used for monitoring and control of the coiled tubing drilling operations. Surface instrumentation 50 is used to receive, record, process and output data from the ranging equipment 34 and logging tools 36, and to control the steering tool 32 and orienter 54, during the drilling operation.

One or more communication lines 52 extend between the surface instrumentation 50 and the steering tool 32, logging tools 36, the ranging equipment 34 and the orienter 54. The communication lines 52 extend through the coiled tubing 24 to the drilling BHA 26. In this manner, ranging operations can be performed while the drilling BHA 26 remains in the well, so that only a single trip of the tubular string 22 may be needed to drill the intercept wellbore 20.

As depicted in FIG. 1, the intercept wellbore 20 is drilled out of a downhole or distal end 56 of the original wellbore 18. In the FIG. 1 example, the distal end 56 of the original wellbore 18 is just uphole of the obstruction 14. In other examples described more fully below, the intercept wellbore 20 can be drilled outward from a window formed through the casing string 16 of the original wellbore 18.

As depicted in FIG. 1, the intercept wellbore 20 is drilled so that it intersects the target wellbore 12 at a window 58 formed through the casing string 16 of the target wellbore 12. In other examples, other types of openings (such as, perforations, etc.) may be used instead of, or in addition to, the window 58 to provide fluid communication between the intercept wellbore 20 and the target wellbore 12.

As used herein, the term "intersect" and similar terms (such as, intersecting, intersected, etc.) are used to indicate full or substantially full fluid communication between target and intercept wellbores. It is not necessary for a target wellbore to be penetrated by an intercept wellbore in order for the wellbores to be intersecting. For example, an intercept wellbore could be drilled so that the intercept wellbore passes in close proximity to the target wellbore, and then perforations could be formed (e.g., using abrasive jets or explosive shaped charges) to establish fluid communication between the wellbores.

If it is desired to plug the original and target wellbores 18, 12, cement can now be pumped into the original, target and intercept wellbores, for example, to abandon the well.

Figure 2:
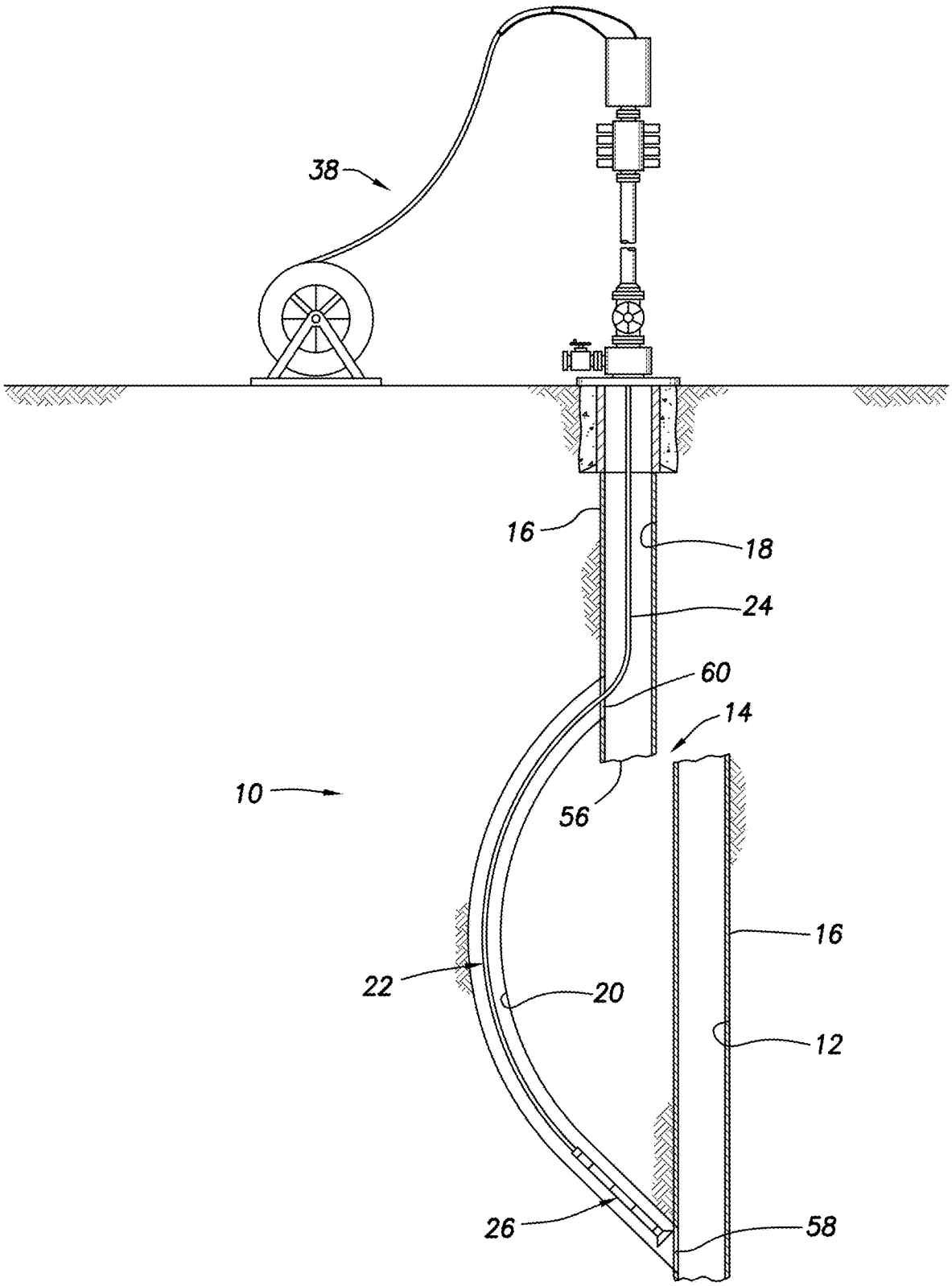
FIGS. 2-8 are representative partially cross-sectional views of further examples of the well system and method.

Referring additionally now to FIG. 2, another example of the system 10 and method is representatively illustrated. The FIG. 2 example is similar in most respects to the FIG. 1 example. However, in the FIG. 2 example, the intercept wellbore 20 is drilled outward from a window 60 formed through the casing string 16 of the original wellbore 18.

Thus, the drilling BHA 26 exits the casing string 16 at the window 60 and the drilling BHA enters the same casing string via the window 58. One of the windows 60 is formed in the original wellbore 18 uphole of the obstruction 14, and the other window 58 is formed in the target wellbore 12 downhole of the obstruction.

As mentioned above, the tubular string 22 can comprise jointed tubing when the window 60 is being formed through the casing 16 of the original wellbore 18. After the window 60 is formed, the tubular string 22 can comprise coiled tubing (such as, for drilling the intercept wellbore 20 to the target wellbore 12). However, the scope of this disclosure is not limited to use of jointed or coiled tubular(s) at any particular point in the drilling operation.

As with the FIG. 1 example, if it is desired to plug the original and target wellbores 18, 12, cement can now be pumped into the original, target and intercept wellbores, for example, to abandon the well.

Referring additionally now to FIGS. 3A & B, another example of the system 10 and method is representatively illustrated. The FIGS. 3A & B example is similar in most respects to the FIG. 2 example. However, in the FIGS. 3A & B example, the drilling BHA 26 enters the target wellbore 12 via the window 58 and is used to clean, wash, drill, mill, fish, etc., in the target wellbore below the obstruction 14.

Figure 3B:
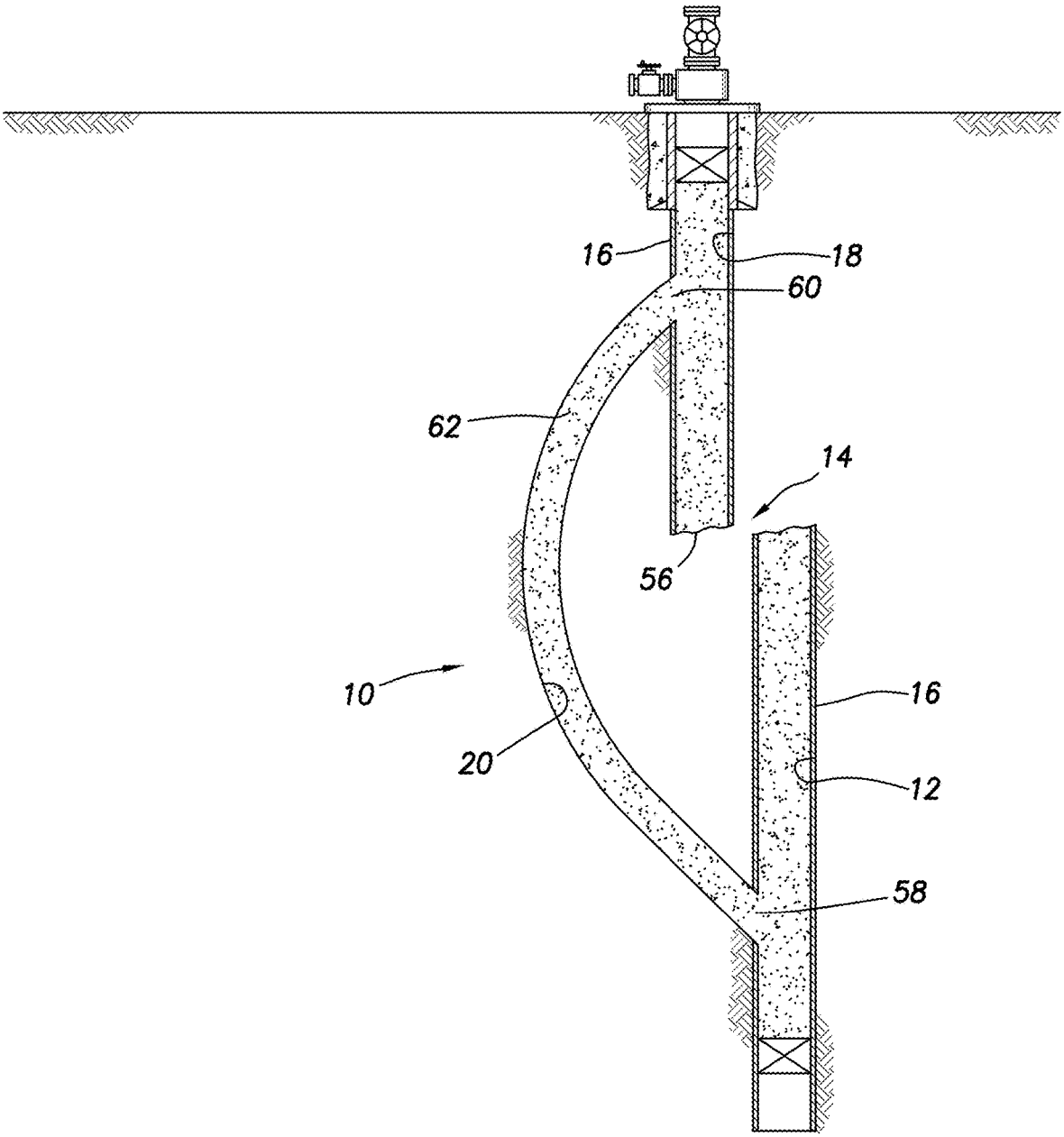

As depicted in FIG. 3B, cement 62 or other sealing material is then pumped through the BHA 26 into the target wellbore 12, the original wellbore 18 and the intercept wellbore 20. The cement 62 may be pumped as the tubular string 22 is withdrawn from the well, in order to "spot" the cement evenly along the length of the target wellbore 12 below the obstruction 14, through the windows 58, 60, the intercept wellbore 20 and the original wellbore 18 above the obstruction. Alternatively, a separate workstring and/or BHA can be used to reenter and place the cement 62 into any of the wellbores 12, 18, 20 to be plugged.

Referring additionally now to FIGS. 4A & B, another example of the system 10 and method is representatively illustrated. The FIGS. 4A & B example is similar in many respects to the FIGS. 3A & B example.

However, in the FIGS. 4A & B example, the intercept wellbore 20 is not drilled so that it intersects the target wellbore 12 at a window. Instead, the intercept wellbore 20 is drilled so that a downhole section of the intercept wellbore is sufficiently adjacent to or proximate the target wellbore 12, so that perforations 64 can be formed between the intercept and target wellbores.

The perforations 64 can be formed using a perforator 66 connected at a distal end of the coiled tubing 24. The perforator 66 may comprise an explosive shaped charge, abrasive fluid, mechanical-type perforator or other type of perforator. The perforations 64 provide fluid communication between the target and intercept wellbores 12, 20.

Figure 4B:
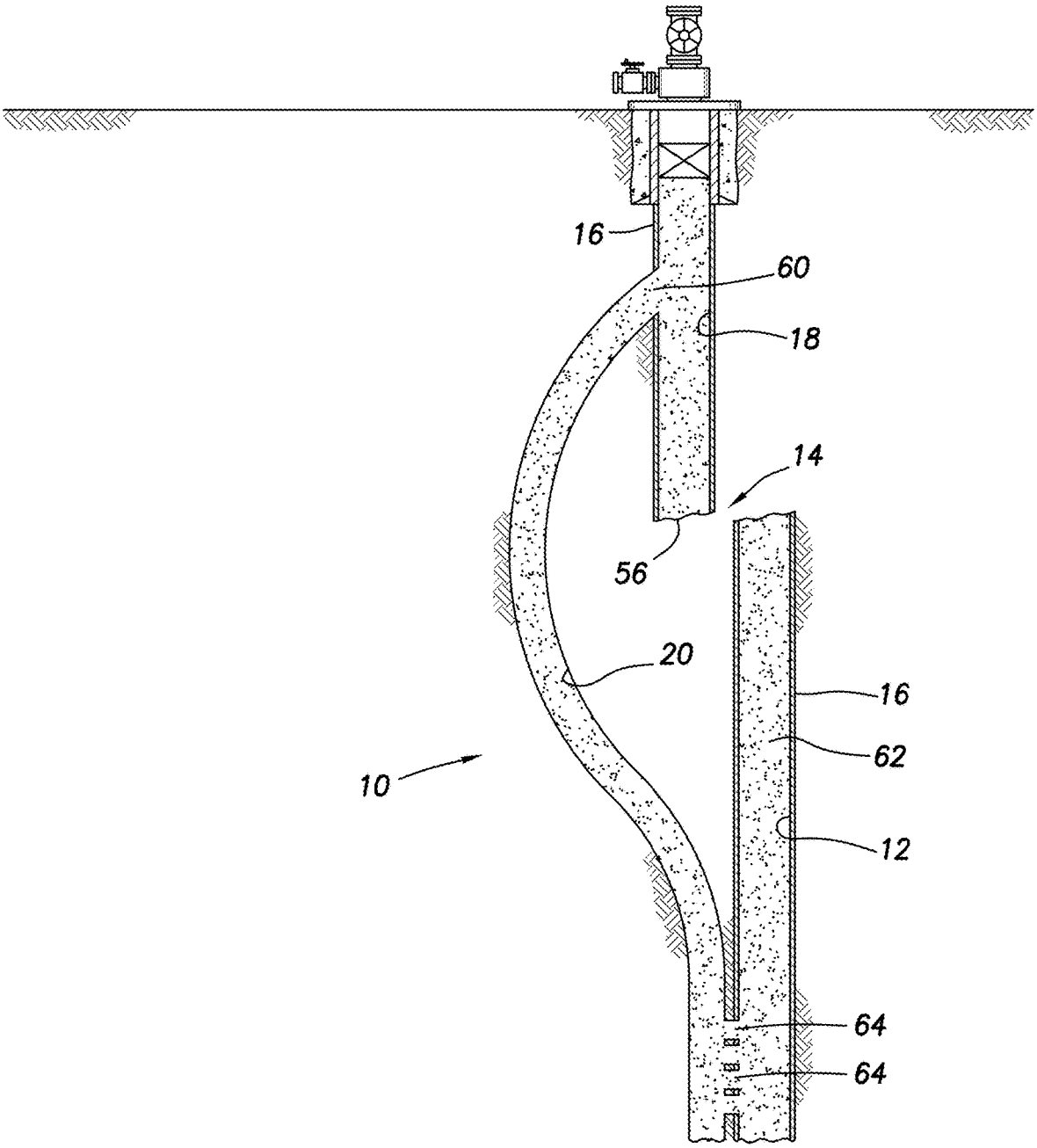

As depicted in FIG. 4B, after the perforations 64 are formed, cement 62 can be pumped through the perforations 64 from the intercept wellbore 20 into the target wellbore 12. The cement 62 may be pumped through the tubular string 22 with the perforator 66 connected, or another trip of the coiled tubing 24 may be used to place the cement.

Referring additionally now to FIGS. 5A-C, another example of the system 10 and method is representatively illustrated. The FIGS. 5A-C example is similar in many respects to the FIGS. 4A & B example. However, in the FIGS. 5A-C example, multiple sets of perforations 64 are formed between the target and intercept wellbores 12, 20.

As depicted in FIG. 5A, the intercept wellbore 20 is drilled so that it extends adjacent the target wellbore 12 a substantial distance. A first set of perforations 64 are formed from the intercept wellbore 20 to the target wellbore 12 using a perforator 66, as in the FIG. 4A example.

As depicted in FIG. 5B, a second set of perforations 64 are formed from the intercept wellbore 20 to the target wellbore 12 using the perforator 66 or another perforator. The tubular string 22 may be retrieved from the well between forming the first and second set of perforations 64, multiple perforators could be connected in the tubular string 22 for forming the respective multiple sets of perforations, or the same perforator may be used to form the multiple sets of perforations.

As depicted in FIG. 5C, cement 62 is pumped into the target wellbore 12 via the perforations 64, the intercept wellbore 20 and the original wellbore 18. The cement 62 can be pumped from the tubular string 22 into one set of perforations 64, through the target 12 wellbore and out of the second set of perforations 64.

In one example, a cementing BHA may be positioned in the intercept wellbore 20 near the downhole set of perforations 64. The cement 62 is then pumped into both the intercept wellbore 20, and the target wellbore 12 through the lower perforations 64. The cement 62 (which is relatively dense) will displace lighter wellbore fluid in both the intercept wellbore 20 and target wellbore 12 up to the upper set of perforations 64.

Cement 62 can also be spotted in the intercept wellbore 20 uphole to the upper set of perforations 64. The tubing 24 is then withdrawn from the intercept wellbore 20 and cement 62 is spotted into the intercept wellbore above the top set of perforations 64 and upper window 60, etc.

Referring additionally now to FIGS. 6A & B, another example of the system 10 and method is representatively illustrated. The FIGS. 6A & B example is similar in many respects to the FIGS. 4A & B example.

However, in the FIGS. 6A & B example, the intercept wellbore 20 is not drilled so that it extends along or parallel to the target wellbore 12. Instead, the intercept wellbore 20 in the FIGS. 6A & B example is drilled so that a distal or downhole end 68 of the intercept wellbore is proximate to, and directed toward or facing, the target wellbore 12.

The perforator 66 in the FIG. 6A example is configured to form one or more perforation(s) 64 in an axial direction from the intercept wellbore 20 to the target wellbore 12. In this manner, fluid communication is provided between the target and intercept wellbores 12, 20.

Figure 6B:
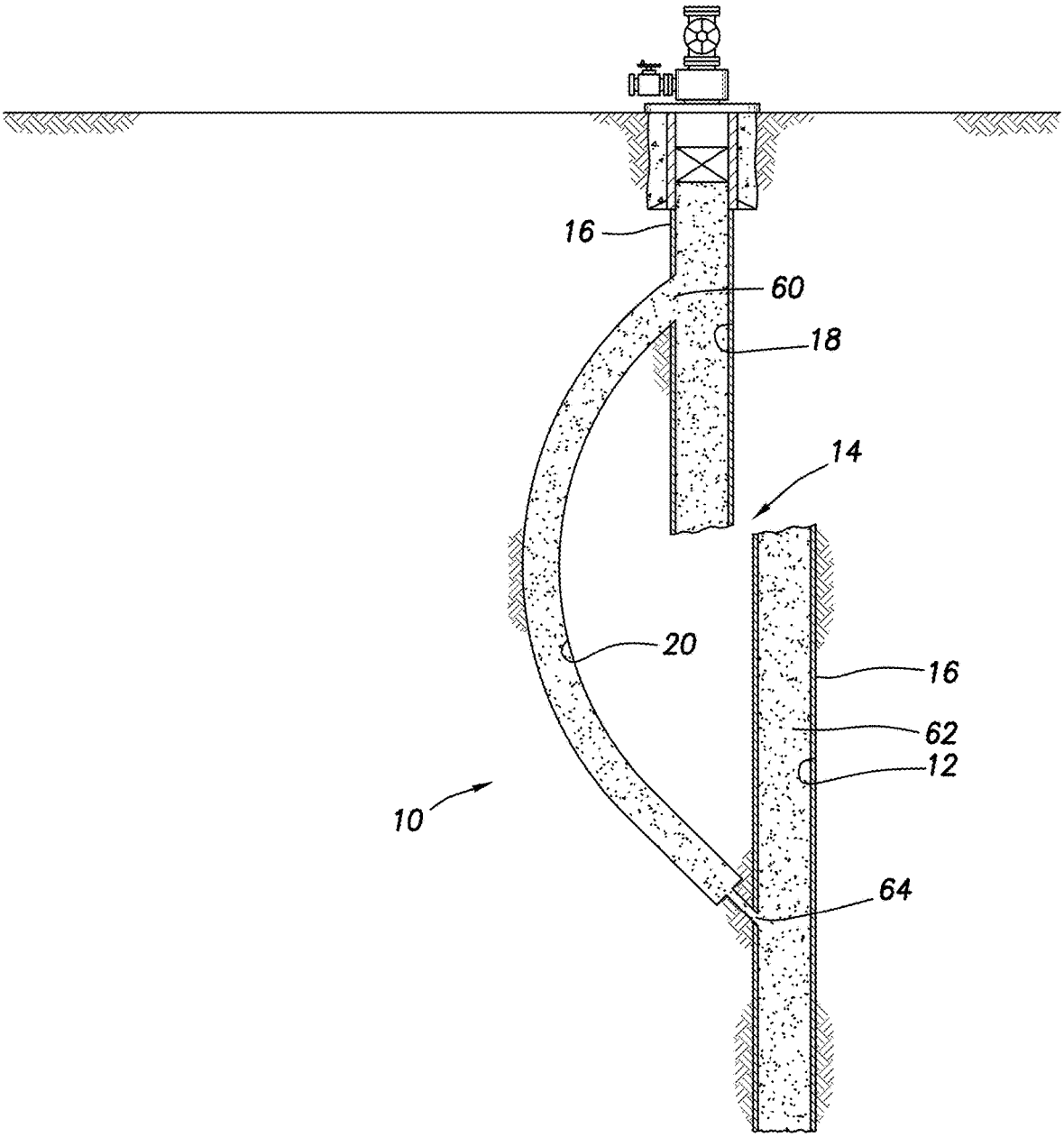

As depicted in FIG. 6B, after the perforation(s) 64 are formed, cement 62 can be pumped through the perforation (s) 64 from the intercept wellbore 20 into the target wellbore 12. The cement 62 may be pumped through the tubular string 22 with the perforator 66 connected, or another trip of the coiled tubing 24 may be used to place the cement.

Referring additionally now to FIGS. 7A & B, another example of the system 10 and method is representatively illustrated. The FIGS. 7A & B example is similar in many respects to the FIGS. 4A & B example.

Figure 7B:
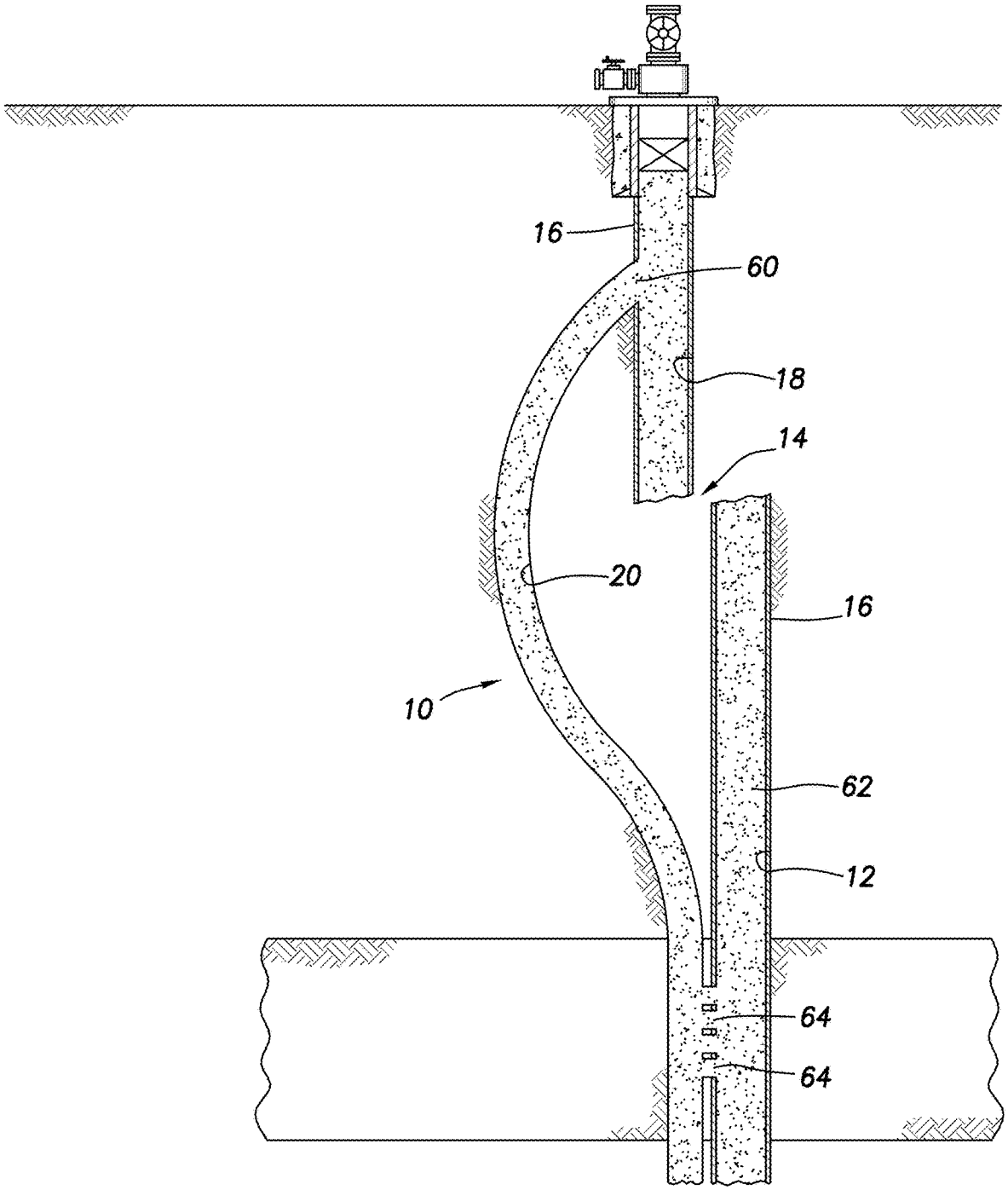

However, in the FIGS. 7A & B example, the intercept wellbore 20 is drilled so that it is proximate or adjacent to the target wellbore 12 at a location in a productive formation 70 (e.g., an earth formation from which fluids can be produced to the surface). The perforations 64 are formed from the intercept wellbore 20 to the target wellbore 12 in the productive formation 70. The perforations 64 allow cement 62 to be pumped from the intercept wellbore 20 into the target wellbore 12 as depicted in FIG. 7B.

Referring additionally now to FIG. 8, another example of the system 10 and method is representatively illustrated. The FIG. 8 example is similar to some of the other examples described above, in that the intercept wellbore 20 is drilled outward from a window 60 formed in the original wellbore 18.

One difference in the FIG. 8 example is that the intercept wellbore 20 is drilled so that it intersects an uphole end 72 of the target wellbore 12. In one example, a drilling pass-by (not shown) may be performed to complete a ranging survey to locate the target wellbore casing 16 and the uphole end 72 of the target wellbore 12. A cement kick plug may then be set or the entire drilled pass-by wellbore may be cemented before drilling to the target wellbore 12.

As depicted in FIG. 8, the drilling BHA 26 has entered the target wellbore 12. Fluid communication is now permitted between the target and intercept wellbores 12, 20. The drilling BHA 26, or another BHA, may be used to clean, wash, drill, mill, fish, etc., in the target wellbore 12 below the obstruction 14.

As in the FIG. 3B example, cement 62 or other sealing material is then pumped through the BHA 26 into the target wellbore 12, the original wellbore 18 and the intercept wellbore 20. The cement 62 may be pumped as the tubular string 22 is withdrawn from the well, in order to "spot" the cement evenly along the length of the target wellbore 12 below the obstruction 14, through the uphole end 72, the window 60, the intercept wellbore 20 and the original wellbore 18 above the obstruction. Alternatively, a separate workstring and/or BHA can be used to reenter and place the cement 62 into any of the wellbores 12, 18, 20 to be plugged.

In any of the above examples, the well may be a municipal, industrial, private, agricultural or other type of well, and may be used for production or injection of oil, gas, water or other fluids.

It may now be fully appreciated that the above disclosure provides significant advancements to the art. In examples described above, the target wellbore 12 downhole of the obstruction 14 can be accessed using a coiled tubing 24 conveyed drilling BHA 26. Drilling and ranging operations can be performed in a single trip of the drilling BHA 26 into a well.

The above disclosure provides a system 10 and method for accessing and/or plugging a wellbore 12 downhole of an obstruction 14 or discontinuity, in which a coiled tubing 24 conveyed BHA 26 simultaneously comprises ranging, orientation and communication capabilities.

A system 10 and method for accessing and/or plugging a wellbore 12 downhole of an obstruction 14 or discontinuity is also described herein. In one example, the wellbore 12 downhole of the obstruction 14 or discontinuity is perforated from outside of casing 16 that lines the wellbore 12. A tubing conveyed perforating gun or an abrasive perforator 66 may be used to perforate into the casing 16.

In one example system 10 and method, the original wellbore 18 is exited uphole of the obstruction 14 or discontinuity, and then fluid communication is established with the target wellbore 12 downhole of the obstruction 14 or discontinuity. The exiting and the establishing communication steps may be performed in a single trip of a tubular string 22 into the well.

The target wellbore 12 downhole of the obstruction 14 or discontinuity may be plugged. A cement 62 plug may be set in the target wellbore 12 downhole of the obstruction 14 or discontinuity. Cement 62 may be pumped into the target wellbore 12 downhole of the obstruction 14 or discontinuity.

Ground penetrating radar or acoustic ranging may used to locate the target wellbore 12 from the intercept wellbore 20.

The above disclosure provides to the art a system 10 for use with a subterranean well. In one example, the system 10 can comprise: a tubular string 22 comprising a drilling bottom hole assembly 26 connected at a distal end of a coiled tubing 24, the coiled tubing 24 comprising a communication line 52 configured to permit communication between surface instrumentation 50 and the drilling bottom hole assembly 26. The drilling bottom hole assembly 26 can comprise an orienter 54 and ranging equipment 34. The tubular string 22 is positioned in an intercept wellbore 20 which intersects a target wellbore 12 downhole of an obstruction 14 that prevents access to the target wellbore 12 downhole of the obstruction 14.

The target wellbore 12 may be lined with a casing string 16. The drilling bottom hole assembly 26 may be configured to cause fluid communication to be permitted between the intercept and target wellbores 20, 12. The drilling bottom hole assembly 26 may be configured to penetrate the casing string 16 from outside of the casing string 16.

The original wellbore 18 uphole of the obstruction 14 may be lined with the same casing string 16. The tubular string 22 may extend outward from the original wellbore 18 via a first window 60 through the casing string 16.

The drilling bottom hole assembly 26 may be configured to form a second window 58 through the casing string 16, the second window 58 providing fluid communication between the intercept and target wellbores 20, 12.

The tubular string 22 may extend through the second window 58. The tubular string 22 may extend through a distal end 56 of the original wellbore 18. The tubular string 22 may extend through an uphole end 72 of the target wellbore 12.

The obstruction 14 may comprise at least one of a break in the casing string 16, a separation of the casing string 16, a collapse of the casing string 16 and a substantial restriction in the casing string 16.

The above disclosure also provides to the art a method of obtaining access to a target wellbore 12 downhole of an obstruction 14. In one example, the method can comprise: drilling an intercept wellbore 20 outward from an original wellbore 18, after an obstruction 14 is introduced between the original wellbore 18 and the target wellbore 12; and intersecting the target wellbore 12 with the intercept wellbore 20, so that fluid communication is provided between the intercept and target wellbores 20, 12.

The drilling step may include drilling the intercept wellbore 20 out of a distal end 56 of the original wellbore 18. The drilling step may include drilling the intercept wellbore 20 out of a window 60 formed in the original wellbore 18.

The intersecting step may include drilling into the target wellbore 12 via a window 58 formed in the target wellbore 12. The intersecting step may include drilling into an uphole end 72 of the target wellbore 12.

The original and target wellbores 18, 12 may be lined with a same casing string 16. The drilling step may include drilling the intercept wellbore 20 outward from the casing string 16.

The intersecting step may include forming an opening through the casing string 16, the opening including at least one of a window 58 and a perforation 64. The forming step may include forming the opening 58, 64 from outside of the casing string 16.

The drilling step may include drilling outward from a first window 60 formed in the casing string 16. The drilling step can also include forming the window 60 with a tubular string 22 comprising jointed tubulars. The intersecting step may include drilling the intercept wellbore 20 with the tubular string 22 comprising coiled tubing 24. The intersecting step may include forming a second window 58 in the casing string 16 from outside of the casing string 16.

The method may include flowing cement 62 into the target wellbore 12, the intercept wellbore 20 and the original wellbore 18.

The drilling step may include deploying a drilling bottom hole assembly 26 into the original and intercept wellbores 18, 20 on a tubular string 22, the drilling bottom hole assembly 26 comprising ranging equipment 34 and an orienter 54. The drilling and intersecting steps may be performed in a single trip of the drilling bottom hole assembly 26 into the intercept wellbore 20.

The drilling step may further include communicating data from the ranging equipment 34 to surface instrumentation 50. The ranging equipment 34 may detect the target wellbore 12 using at least one of acoustic ranging and ground penetrating radar. The ranging equipment 34 may be configured for active magnetic ranging, passive magnetic ranging, or any other type of ranging.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A system for use with a subterranean well, the system comprising:

a tubular string comprising a drilling bottom hole assembly connected at a distal end of a coiled tubing, the coiled tubing comprising a communication line configured to permit communication between surface instrumentation and the drilling bottom hole assembly, and the drilling bottom hole assembly comprising an orienter and ranging equipment;

in which the tubular string exits a pre-existing wellbore uphole of an obstruction that prevents access to a portion of the pre-existing wellbore downhole of the obstruction, in which the portion of the pre-existing wellbore downhole of the obstruction comprises a target wellbore due to the obstruction, and in which the tubular string extends through an intercept wellbore which intersects the target wellbore downhole of the obstruction, so that fluid communication is provided between the pre-existing wellbore uphole of the obstruction and the target wellbore.

2. The system of claim 1, in which the target wellbore is lined with a casing string, and in which the drilling bottom hole assembly is configured to cause fluid communication to be permitted between the intercept and target wellbores.

3. The system of claim 1, in which the target wellbore is lined with a casing string, and in which the drilling bottom hole assembly is configured to penetrate the casing string from outside of the casing string.

4. The system of claim 3, in which the pre-existing wellbore uphole of the obstruction is lined with the casing string.

5. The system of claim 4, in which the tubular string exits the pre-existing wellbore uphole of the obstruction via a first window through the casing string.

6. The system of claim 5, in which the drilling bottom hole assembly is configured to form a second window through the casing string, the second window providing fluid communication between the intercept and target wellbores.

7. The system of claim 6, in which the tubular string enters the target wellbore via the second window.

8. The system of claim 4, in which the tubular string extends through a distal end of the pre-existing wellbore uphole of the obstruction.

9. The system of claim 4, in which the tubular string extends through an uphole end of the target wellbore.

10. The system of claim 3, in which the obstruction comprises at least one of the group consisting of a break in the casing string, a separation of the casing string, a collapse of the casing string and a substantial restriction in the casing string.

11. A method of obtaining access to a target wellbore downhole of an obstruction, the method comprising:

drilling an intercept wellbore outward from an upper portion of an original wellbore, the obstruction dividing the original wellbore into the upper portion and a lower portion, in which the lower portion of the original wellbore comprises the target wellbore; and intersecting the target wellbore with the intercept wellbore, so that fluid communication is provided between the upper portion of the original wellbore and the target wellbore.

12. The method of claim 11, in which the drilling comprises drilling the intercept wellbore out of a distal end of the upper portion of the original wellbore.

13. The method of claim 11, in which the drilling comprises drilling the intercept wellbore out of a window formed in the upper portion of the original wellbore.

14. The method of claim 13, in which the drilling further comprises forming the window with a tubular string comprising jointed tubulars.

15. The method of claim 14, in which the intersecting comprises drilling the intercept wellbore with the tubular string comprising coiled tubing.

16. The method of claim 11, in which the intersecting comprises drilling into the target wellbore via a window formed in the target wellbore.

17. The method of claim 11, in which the intersecting comprises drilling into an uphole end of the target wellbore.

18. The method of claim 11, in which the upper portion of the original wellbore and the target wellbore are lined with a same casing string.

19. The method of claim 18, in which the drilling comprises drilling the intercept wellbore outward from the casing string, and in which the intersecting comprises forming an opening through the casing string, the opening comprising at least one of the group consisting of a window and a perforation.

20. The method of claim 19, in which the forming comprises forming the opening from outside of the casing string.

21. The method of claim 18, in which the drilling comprises drilling outward from a first window formed in the casing string, and in which the intersecting comprises forming a second window in the casing string from outside of the casing string.

22. The method of claim 11, further comprising flowing cement into the target wellbore, the intercept wellbore and the upper portion of the original wellbore.

23. The method of claim 11, in which the drilling comprises deploying a drilling bottom hole assembly into the upper portion of the original wellbore and the intercept wellbore on a tubular string, the drilling bottom hole assembly comprising ranging equipment and an orienter.

24. The method of claim 23, in which the drilling further comprises communicating data from the ranging equipment to surface instrumentation.

25. The method of claim 23, in which the drilling and intersecting are performed in a single trip of the drilling bottom hole assembly into the intercept wellbore.

26. The method of claim 23, in which the ranging equipment detects the target wellbore using at least one of the group consisting of acoustic ranging and ground penetrating radar.

* * * * *